US006248979B1

(12) United States Patent
Cafaro

(10) Patent No.: US 6,248,979 B1
(45) Date of Patent: Jun. 19, 2001

(54) HAIR CURLING ROLLER HEATING SYSTEM WITH RESISTIVE HEATING PLATE AND HALOGEN BULB EMITTING HEAT AND LIGHT

(75) Inventor: Michael Cafaro, El Paso, TX (US)

(73) Assignee: Helen of Troy, L.P., El Paso, TX (US)

( * ) Notice: Subject to any disclaimer, the term of this patent is extended or adjusted under 35 U.S.C. 154(b) by 0 days.

(21) Appl. No.: 09/592,381

(22) Filed: Jun. 12, 2000

(51) Int. Cl.[7] ..... A45D 2/10

(52) U.S. Cl. ..... 219/222; 219/385; 219/220; 219/242; 132/229; 392/418

(58) Field of Search ..... 219/222, 226, 219/385, 386, 521, 220, 506, 242; 132/229, 269, 271; 392/418

(56) References Cited

U.S. PATENT DOCUMENTS 3,519,793 * 7/1970 Solomon ..... 132/229
3,600,552 * 8/1971 Tolmie ..... 219/222
3,610,878 * 10/1971 Thomas et al. ..... 219/222
5,117,090 * 5/1992 Askins ..... 219/222
5,606,983 * 3/1997 Monty et al. ..... 132/229

* cited by examiner

*Primary Examiner*—John A. Jeffrey
(74) *Attorney, Agent, or Firm*—John E. Toupal; Harold G. Jarcho

(57) ABSTRACT

A hair-curling roller heating system including a plurality of rollers supported on posts heated by both a resistive heating plate and a halogen bulb which emits both visible light and radiant heat in the form of infrared radiation. The posts have open top ends and the rollers have differently colored translucent upper tips which receive light from the posts and thereby identify different types of rollers.

16 Claims, 7 Drawing Sheets

HAIR CURLING ROLLER HEATING SYSTEM WITH RESISTIVE HEATING PLATE AND HALOGEN BULB EMITTING HEAT AND LIGHT

BACKGROUND OF THE INVENTION

The invention relates to a system for heating haircurling rollers. Hair-curling roller heating systems having a plurality of hair curling rollers mounted on post members that conduct heat to the rollers are well known in the prior art. The rollers in a particular system might be of several different types; smaller and larger diameters, more or fewer bristles, longer or shorter bristles, etc.

Typically in such systems the high temperature of the rollers can only be realized by touching them. There is typically no visual indicator at the rollers themselves to alert the user that the system is energized and producing heat. The use of an indicator lamp has been tried to provide an indication that the system is energized and hot, but such an indicator, separate from the rollers themselves, has proven ineffective in preventing users from improperly handling hot rollers and burning themselves. This is a drawback common among prior art hair-curling roller heating systems.

Also typically, in such systems, the rollers of various types can be difficult to differentiate at a glance. The user must generally remove a hot roller to examine it closely in order to know what type it is. This is another drawback common among prior art hair-curling roller heating systems.

OBJECTS OF THE INVENTION

An object of the present invention is to provide an improved hair-curling roller heating system.

Another object of the present invention is to provide such a system in which the rollers are illuminated when the system is energized to warn the user that the system is energized and the rollers are likely to be hot.

A further object of the invention is to provide the rollers with translucent ends that glow in various colors to differentiate one roller type from another at a glance.

A further object of the present invention is to provide such a system wherein the source of illuminating the rollers is combined with the heating source.

A further object of the present invention is to provide such a system wherein the source of illuminating the rollers and the source of heating the rollers is a single source.

SUMMARY OF THE INVENTION

The hair-curling roller heating system in accordance with the present invention includes a plurality of rollers and a housing having a lid. The housing includes a plurality of hollow posts on which the rollers are removably mounted for heating.

The housing further includes heating means, which comprise both a resistive heating plate and a halogen bulb. The bulb emits both visible light and radiant heat in the form of infrared radiation. The visible light glows through the open top ends of the posts.

The rollers are adapted with colored translucent upper tips to allow the light from the posts to glow through. The tips of each roller type share a common color, but rollers of different types, say for instance different diameters or different bristle densities, may be made of different colors.

When the rollers are mounted on the posts and the system is energized, the roller tips glow in various colors according to their type, even though the rollers are not themselves electrically energized. The user can immediately ascertain that the system is energized and the rollers are likely hot just by glancing at the rollers. The user can instantly recognize the type of each roller without the need to remove and examine them.

DESCRIPTION OF THE PREFERRED EMBODIMENT

Figure 1:
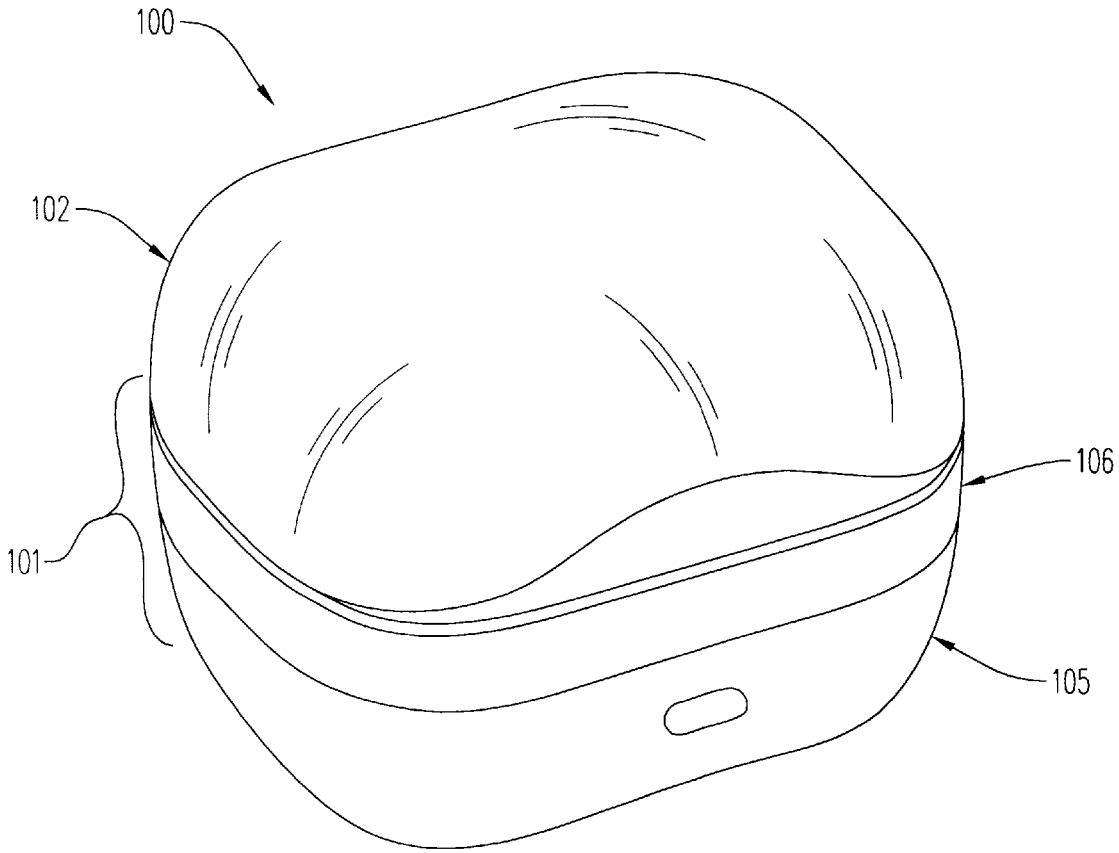
FIG. 1 is a perspective view of a hair-curling roller heating system in accordance with the preferred embodiment of the present invention.

The preferred embodiment of the invention is depicted in FIGS. 1 through 4, with a typical roller of the preferred embodiment depicted in FIGS. 5 through 9. The hair-curling roller heating system 100 comprises housing 101, lid 102, and rollers 103.

The housing includes a cup-shaped base 105 with a similarly shaped shroud 106 affixed thereupon. Encased within the housing are a heating post assembly 107 including a resistive heating plate 108 that is sandwiched between an upper plate 110 and a lower plate 111. The upper plate includes sixteen cylindrical hollow posts 113 and is made of a thermally conductive material, preferably aluminum. The upper plate is affixed in planar contact to the heating plate in a thermally cooperative manner such that heat emitted from the heater plate is quickly conducted through the upper plate and into the posts. The hollow posts extend upwardly through the bottom wall 114 of the shroud and have open upper ends 115 and open lower ends that form holes 117 through the upper plate. Each of the heating plate and the lower plate also has sixteen holes 118,119, respectively that are aligned with the upper plate holes and the posts. It is also anticipated and intended that these holes could be filled or covered with any suitable translucent material, so long as light may pass from under the lower plate and upwardly through and from the posts.

Also enclosed within the housing is a halogen lamp 121 that is captured by mounting connectors 122 and immediately surrounded by insulating basket 123. When the halogen lamp is energized, it emits both infrared heat and visible light. A portion of the light 125 (FIG. 2A) glows upwardly through the holes 118,119 and posts and from the open upper ends 115. The heat generated by the lamp is insulated below and around, but not above, by the insulating basket 123 to avoid overheating of the surrounding base 105. This infrared heat is eventually absorbed by the heating post assembly and conducted to the posts. This heat is contained within the system by the closed transparent lid 102, which is removably mounted on the shroud 106 and over the posts. The transparency of the lid allows the rollers to be viewed without removing the lid.

Figure 2:
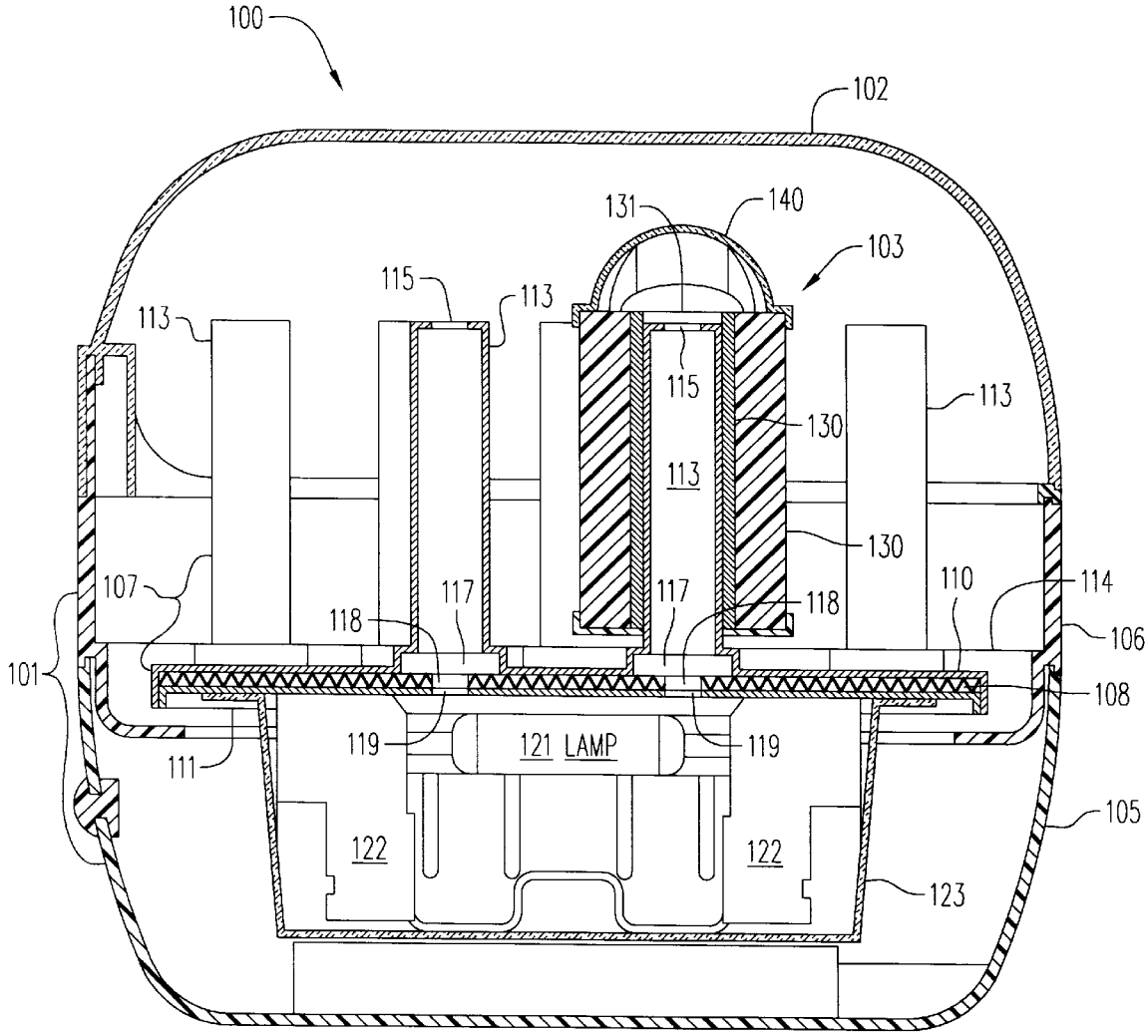
FIG. 2 is a sectional side view of the system of FIG. 1.
Figure 2A:
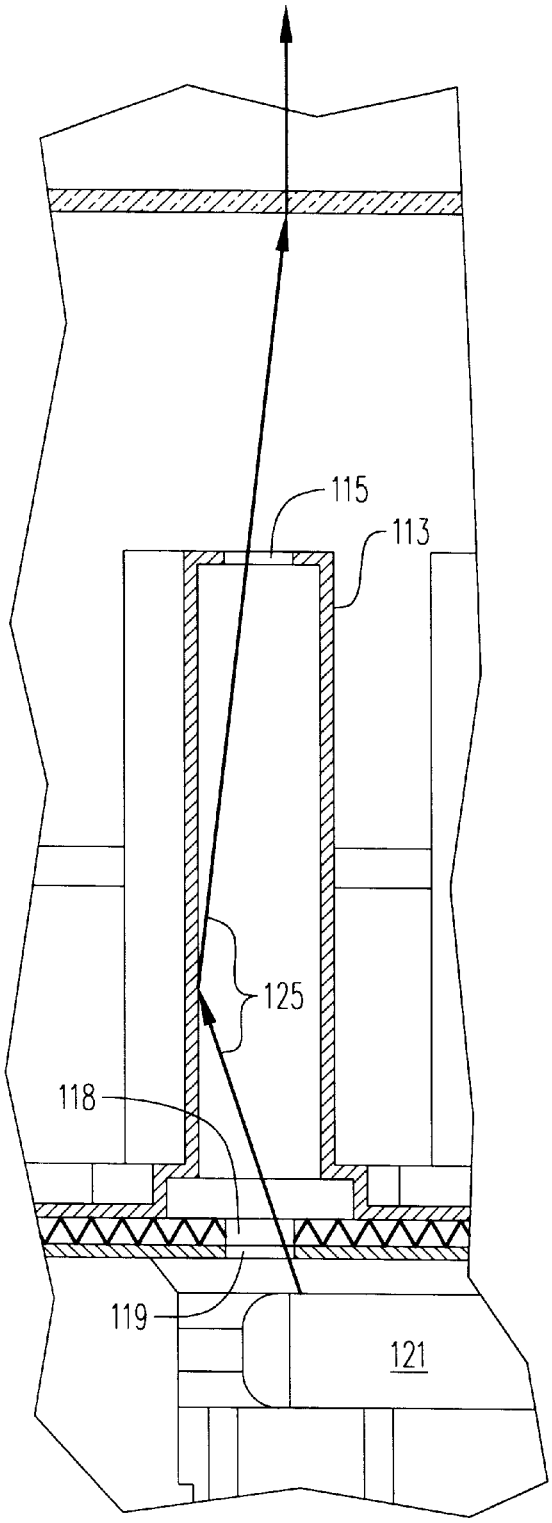
FIG. 2A is a cut-out portion of FIG. 2.
Figure 3:
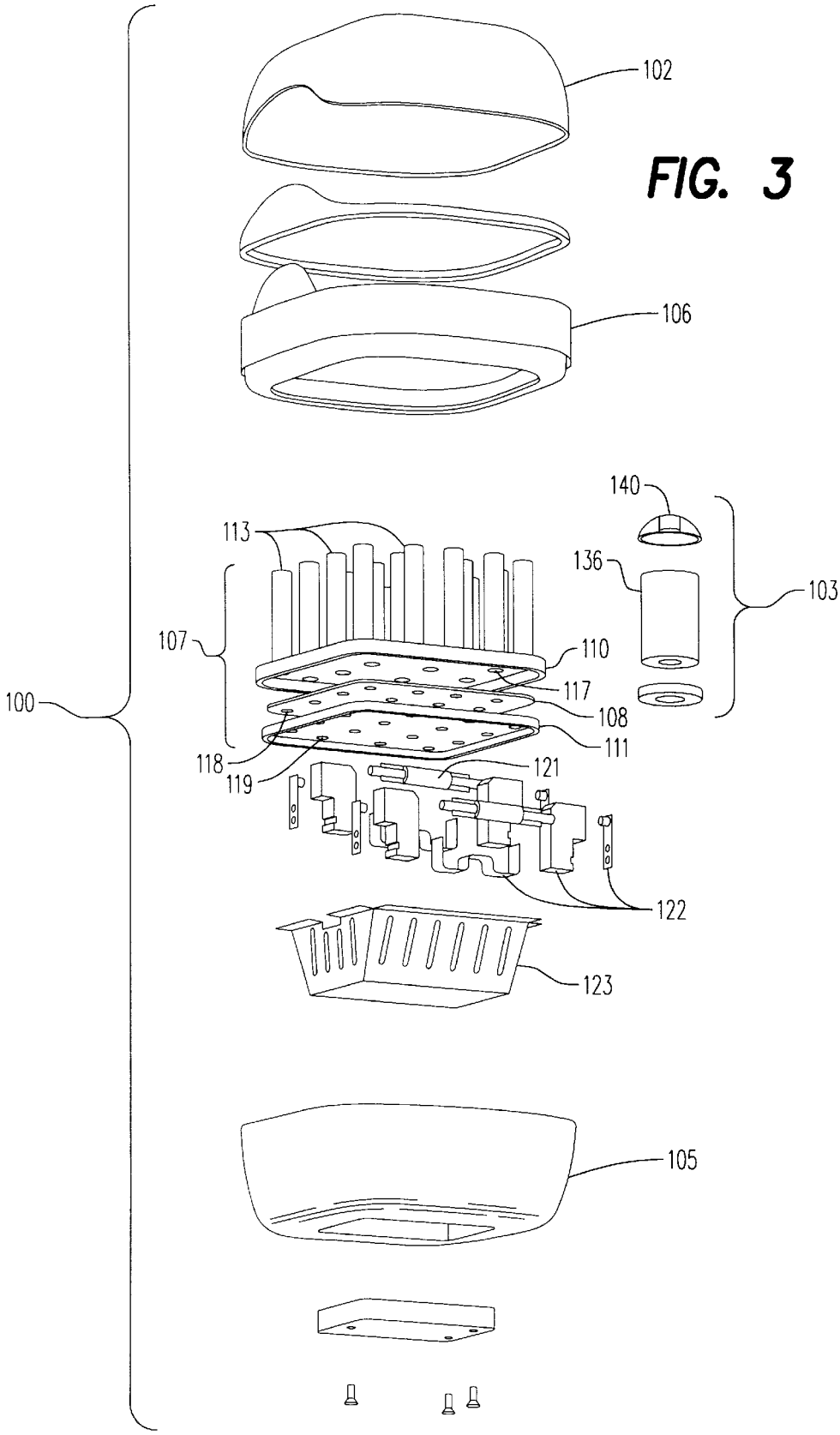
FIG. 3 is an exploded view of the system of FIG. 1.
Figure 4:
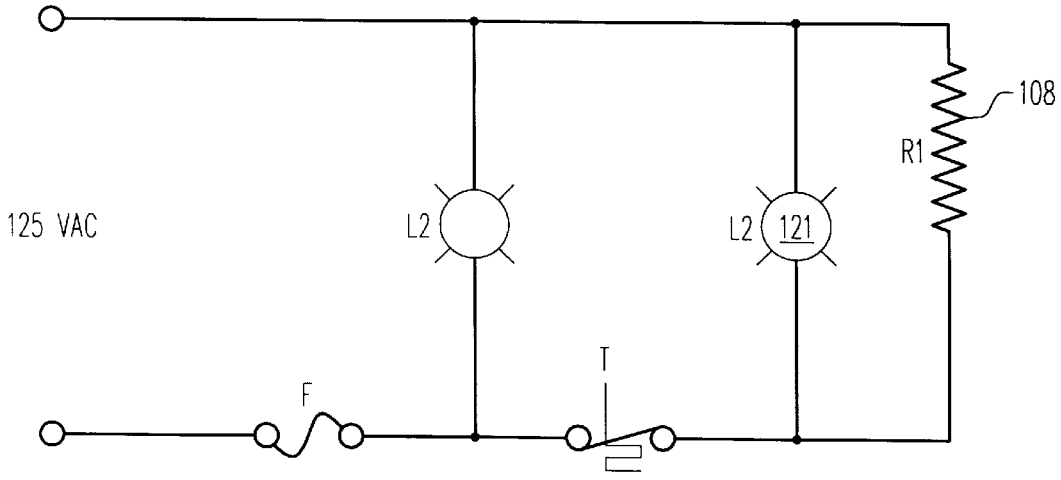
FIG. 4 is a diagram of the electrical circuit of the system of FIG. 1.
Figure 5:
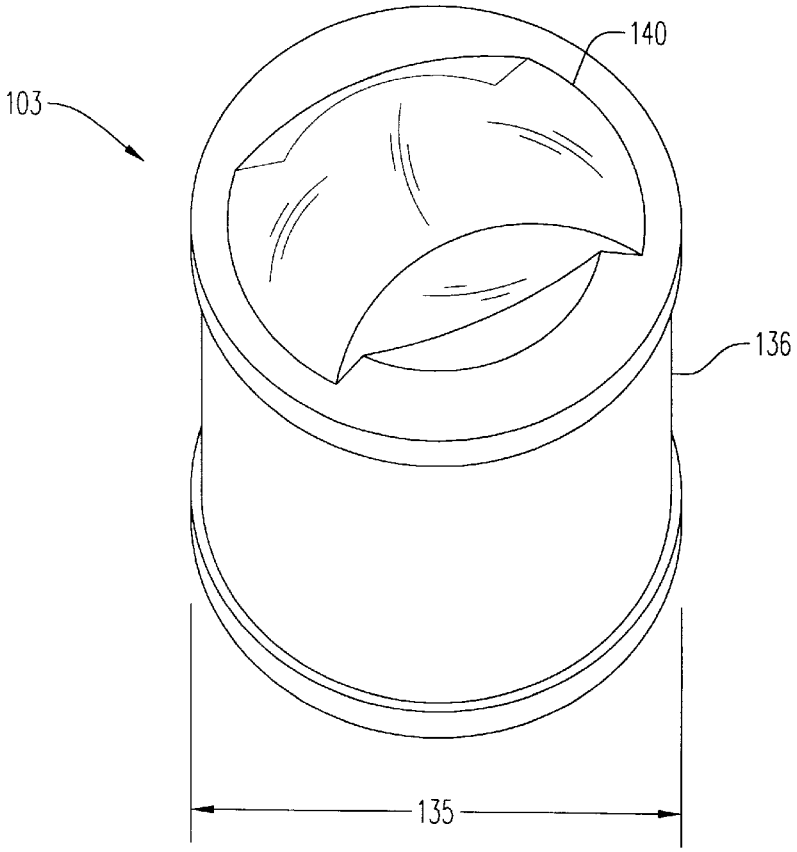
FIG. 5 is a perspective view of a hair-curling roller of the system of FIG. 1.
Figure 6:
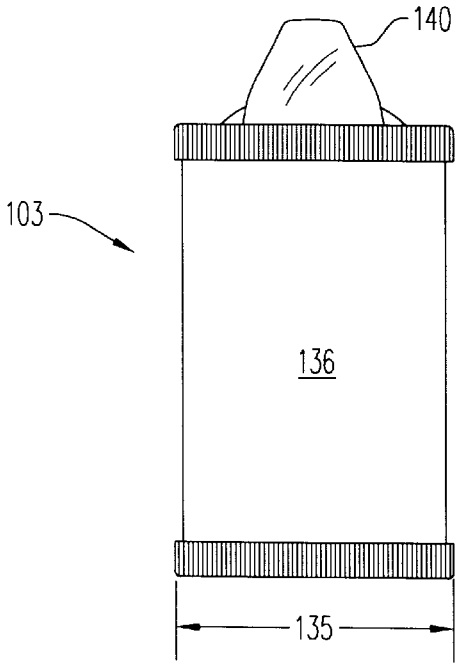
FIG. 6 is a side view of the roller of FIG. 5.
Figure 7:
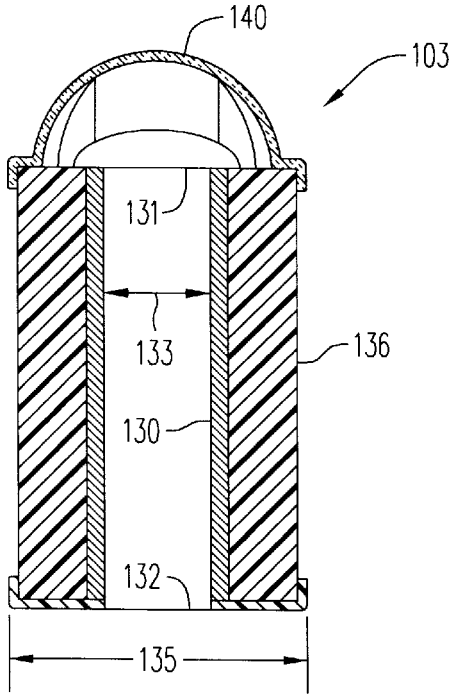
FIG. 7 is a sectional side view of the roller of FIG. 5.
Figure 8:
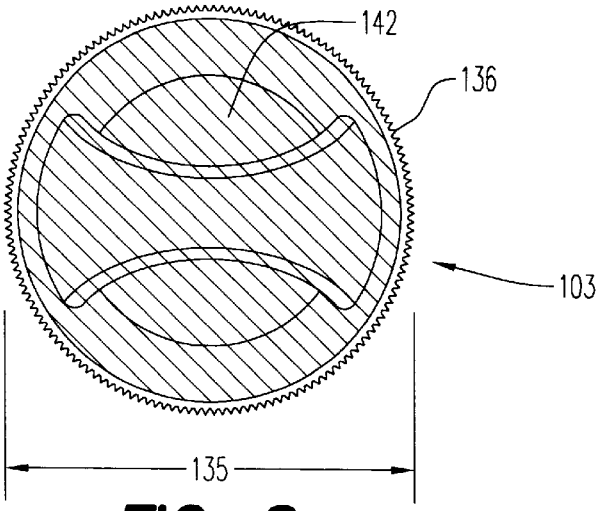
FIG. 8 is a top view of the roller of FIG. 5.
Figure 9:
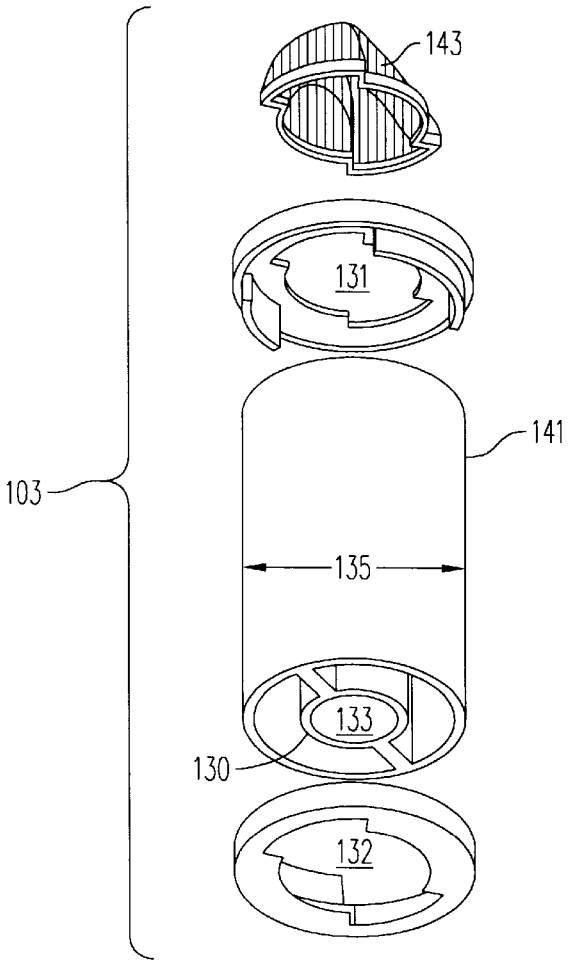
FIG. 9 is an exploded view of the roller of FIG. 5.

A typical roller, as shown in FIGS. 5 through 9, is comprised of a thermally conductive tube 130 having open top 131 and bottom 132 ends. The inner diameter 133 is adapted to fit matingly over the outer diameter 135 of any one of the posts, as best seen in FIG. 2, with enough precision and contact to provide for effective thermal transfer from the post to the tube, thus heating the roller. There are sixteen rollers to the system, one for each post.

The tube is surrounded by a wider cylindrical roller body 136 which might have any known roller construction; it might be bristled or smooth, it might have a large or small outer diameter 135, it might be hard or soft, etc. FIGS. 5 through 9 show a smooth cylindrical roller, but it is anticipated that any of these alternate prior art roller types can be adapted to the system and would only vary from the shown roller in outer diameter, material, outer shape, and tip color.

Upper tip 140 is affixed to the top end of the roller and is translucent so that light glowing from the open upper end 115 of a post shines through the tip and is viewable by the user even when the roller is fitted over the post. Since various rollers might have various qualities, as stated, the basic color of the translucent tips varies according to the qualities of the roller to which it is affixed. For instance, larger diameter smooth soft rollers 136 (FIG. 7) might have green tips 142 (FIG. 9) while smaller diameter hard rollers 141 (FIG. 9) might have red tips 143.

In use, the sixteen rollers are positioned on the sixteen posts and the system is energized, whereupon the heating plate begins to emit heat and the halogen lamp begins to emit infrared heat and visible light. The light passing upward through the posts shines through, but is colored by the roller tips 140,142,143. At a glance, the user instantly appreciates that the rollers are being heated and knows to select a particular roller type according to its glowing color. When use is completed, the user is reminded by the glowing light that the system is still energized, and should be deenergized.

It should be understood that the described embodiment is merely the preferred of many possible embodiments still within the spirit of the invention, and that the scope of the invention should be limited only by the following claims.

What is claimed is:

1. A hair-curling roller heating system comprising:

a plurality of hair curling rollers each comprising a translucent portion;

a housing comprising:

a heat source;

a visible light source; and a plurality of posts in thermal cooperation with said heat source, each post arranged and adapted to removably accept one of said rollers wherein said one roller's translucent portion is visually exposed to view, each said post arranged and adapted to heat said one of said rollers, at least one of said posts having a window associated therewith such that visible light from said light source glows through said window, and from said exposed translucent portion of said one roller removably accepted thereby.

2. The hair-curling roller heating system of claim 1 wherein said plurality of rollers comprise rollers having various physical properties and said translucent portions are translucently colored in various colors, each of said colors corresponding to the physical properties of that roller.

3. The hair-curling roller system of claim 2 wherein said heat source and said visible light source comprise a lamp and said window comprises an opening, and heat from said lamp passes through said opening and heats said post associated therewith.

4. The hair-curling roller system of claim 3 wherein said heat source further comprises a resistive heater for conductively heating said posts.

5. The hair-curling roller system of claim 4 further comprising a removable lid, covering said housing and said rollers, and adapted to retain heat therewithin.

6. The hair-curling roller system of claim 5 wherein said lid is transparent and said translucent portions are visually exposed therethrough.

7. The hair-curling roller heating system of claim 1 wherein each said post has a window associated therewith such that visible light from said light source glows through each said window, and from said exposed translucent portion of said one roller removably accepted thereby.

8. The hair-curling roller heating system of claim 7 wherein said plurality of rollers comprise rollers having various physical properties and said translucent portions are translucently colored in various colors, each of said colors corresponding to the physical properties of that roller.

9. The hair-curling roller system of claim 8 wherein said heat source and said visible light source comprise a lamp and said each window comprises an opening, and heat from said lamp passes through each said opening and heats said post associated therewith.

10. The hair-curling roller system of claim 9 wherein said heat source further comprises a resistive heater for conductively heating said posts.

11. The hair-curling roller system of claim 10 further comprising a removable lid, covering said housing and said rollers, and adapted to retain heat therewithin.

12. The hair-curling roller system of claim 11 wherein said lid is transparent and said translucent portions are visually exposed therethrough.

13. A hair-curling roller heating system comprising:

a plurality of hair-curling rollers each comprising a translucent end;

a housing comprising:

a heat source comprising a halogen heating lamp and a resistive heater;

a visible light source comprising a halogen lighting lamp;

a plurality of posts in thermal cooperation with said heat source, each post arranged and adapted to removably accept one of said rollers wherein said one roller's translucent end is visually exposed to view, each said post arranged and adapted to heat said one of said rollers, each said post having a window associated therewith such that visible light from said halogen lighting lamp glows through said each window, and from said exposed translucent end of said one roller removably accepted thereby.

14. The hair-curling roller heating system of claim 13 wherein said halogen heating lamp is said halogen lighting lamp.

15. The hair-curling roller heating system of claim 14 wherein said plurality of rollers comprise rollers having various physical properties and said translucent ends are translucently colored in various colors, each of said colors corresponding to the physical properties of that roller.

16. A hair-curling roller heating system comprising:

a housing portion;

a visible light-emitting lamp within said housing portion;

a resistive heater within said housing portion;

a plurality of cylindrical hair-curling rollers each comprising an open end and a translucently colored end, each roller having a particular physical property and each said translucently colored end having a particular color corresponding thereto;

a removable transparent lid covering said housing and said rollers;

a plurality of hollow posts in thermal cooperation with said heater, each post arranged and adapted to removably accept one of said rollers wherein said one roller's translucently colored end is visually exposed to view through said transparent lid, each said post arranged and adapted to transfer heat from said heater to said one of said rollers, each said post arranged and adapted to allow light from said lamp to said translucently colored end of said roller associated therewith; and said light becomes colored light and said colored light glows through said lid from said translucently colored ends of said rollers when said heater and lamp are energized.

* * * * *